US008813629B1

(12) United States Patent
Holmes et al.

(10) Patent No.: US 8,813,629 B1
(45) Date of Patent: Aug. 26, 2014

(54) POSITIONAL LOCK FOR CARRIER ASSEMBLY OF BREECH-LOADED WEAPON

(75) Inventors: Edward W. Holmes, Valley Falls, NY (US); Wayland P. Barber, Mechanicville, NY (US); Leslie C. Blahut, Westfield, MA (US); Paul J. Koelbel, Albany, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 49 days.

(21) Appl. No.: 13/494,375

(22) Filed: Jun. 12, 2012

(51) Int. Cl.
*F41A 3/00* (2006.01)
*F41A 3/06* (2006.01)

(52) U.S. Cl.
CPC ..... *F41A 3/06* (2013.01)
USPC ..... 89/18

(58) Field of Classification Search
USPC ..... 89/17–20.2, 25, 31, 180–181; 42/9, 42/14–16, 26–27, 38, 40, 75.01–75.1
See application file for complete search history.

(56) References Cited

U.S. PATENT DOCUMENTS

| | | | | | |
|---|---|---|---|---|---|
| 1,483,161 | A * | 2/1924 | Dawson et al. | 89/20.2 |
| 1,559,106 | A * | 10/1925 | Julstedt | 89/20.2 |
| 1,695,728 | A * | 12/1928 | Dawson et al. | 89/20.2 |
| 2,425,846 | A * | 8/1947 | Trewren | 114/178 |
| 2,715,212 | A * | 8/1955 | Kokalas et al. | 439/144 |
| 3,362,292 | A * | 1/1968 | D'Andrea | 89/24 |
| 3,402,846 | A * | 9/1968 | Zerwes | 220/3.8 |
| 5,291,820 | A * | 3/1994 | Hainsworth et al. | 89/1.806 |
| 6,132,227 | A * | 10/2000 | Boteler et al. | 439/142 |
| 7,318,369 | B1 * | 1/2008 | Madigan et al. | 89/27.13 |
| 8,141,469 | B1 * | 3/2012 | Holmes et al. | 89/17 |
| 8,272,307 | B1 * | 9/2012 | Holmes et al. | 89/19 |
| 2010/0192439 | A1 * | 8/2010 | Murello | 42/1.06 |

* cited by examiner

*Primary Examiner* — Michael David
*Assistant Examiner* — Benjamin Gomberg
(74) *Attorney, Agent, or Firm* — Michael C. Sachs

(57) ABSTRACT

A breech assembly for a weapon may include a breech ring and a carrier fixed to a shaft. The shaft may be rotatably mounted to the breech ring. A breech block may be fixed to the carrier and insertable into and out of an opening in the breech ring by rotating the shaft. A notch may be formed in an end of the shaft. A lock may be translatably disposed in the breech ring and translatable into and out of the notch in the end of the shaft. Translation of the lock into the notch may rotatably lock the shaft with respect to the breech ring.

2 Claims, 9 Drawing Sheets

POSITIONAL LOCK FOR CARRIER ASSEMBLY OF BREECH-LOADED WEAPON

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to direct and indirect fire weapons.

Direct and indirect fire weapons, for example, cannons and/or breech-loaded mortars, may include a screw block and carrier assembly at the breech end of the weapon. The screw block and carrier assembly may be opened for maintenance. Known apparatus for retaining the screw block and carrier assembly in an open position include a non-rigid strap, a block of wood, or a rod. The strap is unsafe because it may slip. The block of wood is unsafe because it may disintegrate. The rod generally requires more than one person to safely deploy. All three methods are time-consuming and potentially dangerous to the maintenance operator.

A long-felt and unsolved need exists for an apparatus and method that enables a single person to rapidly and safely lockout a screw block and carrier in an open position at a predetermined angle.

SUMMARY OF THE INVENTION

It is an object of the invention to provide an apparatus and method that enables a single person to rapidly and safely lockout a screw block and carrier in an open position at a predetermined angle.

A breech assembly for a weapon may include a breech ring and a carrier fixed to a shaft. The shaft may be rotatably mounted to the breech ring. A breech block may be fixed to the carrier. The breech block may be insertable into and out of an opening in the breech ring by rotating the shaft. A notch may be formed in an end of the shaft. A lock may be translatably disposed in the breech ring and translatable into and out of the notch in the end of the shaft. Translation of the lock into the notch may rotatably lock the shaft with respect to the breech ring.

The lock may include a slide body and a spring that biases the slide body towards the shaft. The slide body may include grooves formed therein for retaining the slide body in the breech ring. The lock may include a latching assembly for securing the lock out of engagement with the notch.

In one embodiment, the latching assembly may include a plunger disposed in a bore in the slide body and a plunger spring that biases the plunger toward the breech ring. The plunger may include a detent on an end thereof. Another end of the plunger may include a knob for pulling the plunger.

In another embodiment, the latching assembly may include a pivoting latch that is rotatably fixed to the slide body and selectively engageable with the breech ring. The latching assembly may include a latch spring that biases the pivoting latch toward the breech ring. The slide body may include a hinge pin on which the pivoting latch is rotatably mounted. The pivoting latch may include a slotted opening at an end distal the hinge pin. The pivoting latch may include a button and the breech ring may include a keyhole slot. The button may be selectively engageable with the keyhole slot.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A positional lock may allow a single operator to rapidly and safely open or lockout a screw block and carrier of a weapon at a predetermined angular position. The operator may deploy the locking device prior to opening the breech block. The breech block and carrier assembly may be safely locked out when, for example, notches in the crank or crank end align with a locking tab.

A semi-automatic locking mechanism may deploy a locking tab into a notch to securely hold the screw block and carrier assembly open during maintenance operations. The locking mechanism may be located on the breech ring. The locking mechanism may be activated by releasing a knob and/or a latch. Releasing the knob or latch may cause a spring-loaded locking tab to deploy into a notch. The notch may be located on the crank or the crank end. The tab and notch may firmly lock and hold the breech block and carrier assembly in an open position at a specified angle.

Figure 1:
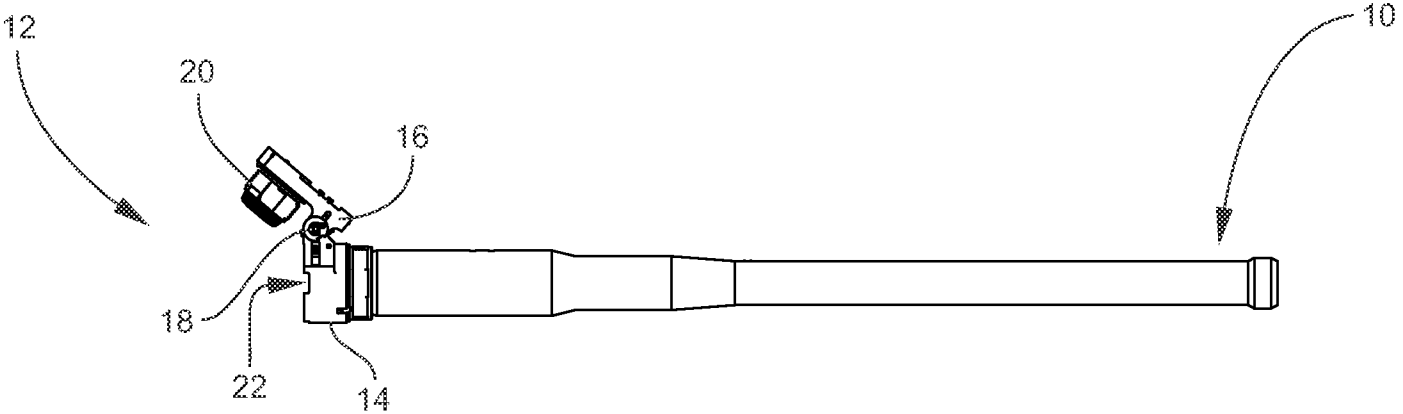
FIG. 1 is a side view of an embodiment of a breech-loaded weapon.

FIG. 1 is a side view of an embodiment of a breech-loaded weapon 10. Weapon 10 may include a breech assembly 12. Breech assembly 12 may include a breech ring 14. A shaft 18 may be rotatably mounted to breech ring 14. A carrier 16 may be fixed to shaft 18. A breech block 20 may be fixed to carrier 16. Breech block 20 may be insertable into and out of an opening 22 in breech ring 14 by rotating shaft 18. In FIG. 1, breech block 20 is shown in an open position with breech block 20 rotated out of opening 22 in breech ring 14.

Figure 2:
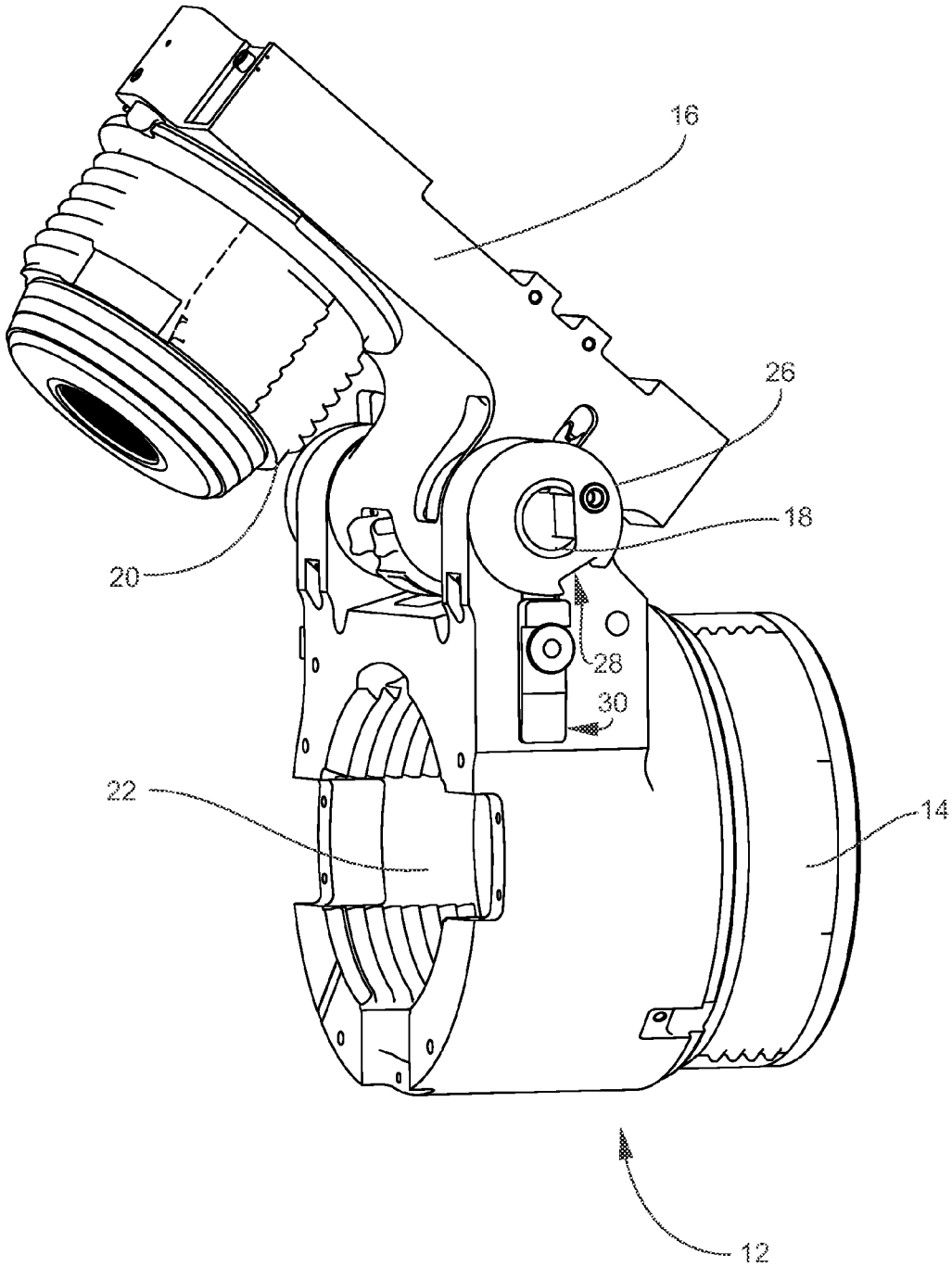
FIG. 2 is a perspective view of a breech assembly showing a breech block in an open position prior to being locked in the open position.

FIG. 2 is a perspective view of breech assembly 12 showing breech block 20 in an open position prior to being locked in the open position. Shaft 18 may include a crank end 26. Crank end 26 may include a notch 28 formed in a periphery thereof. A lock 30 may be translatably disposed in breech ring 14. Lock 30 may be translatable into and out of notch 28 in crank end 26.

Figure 3:
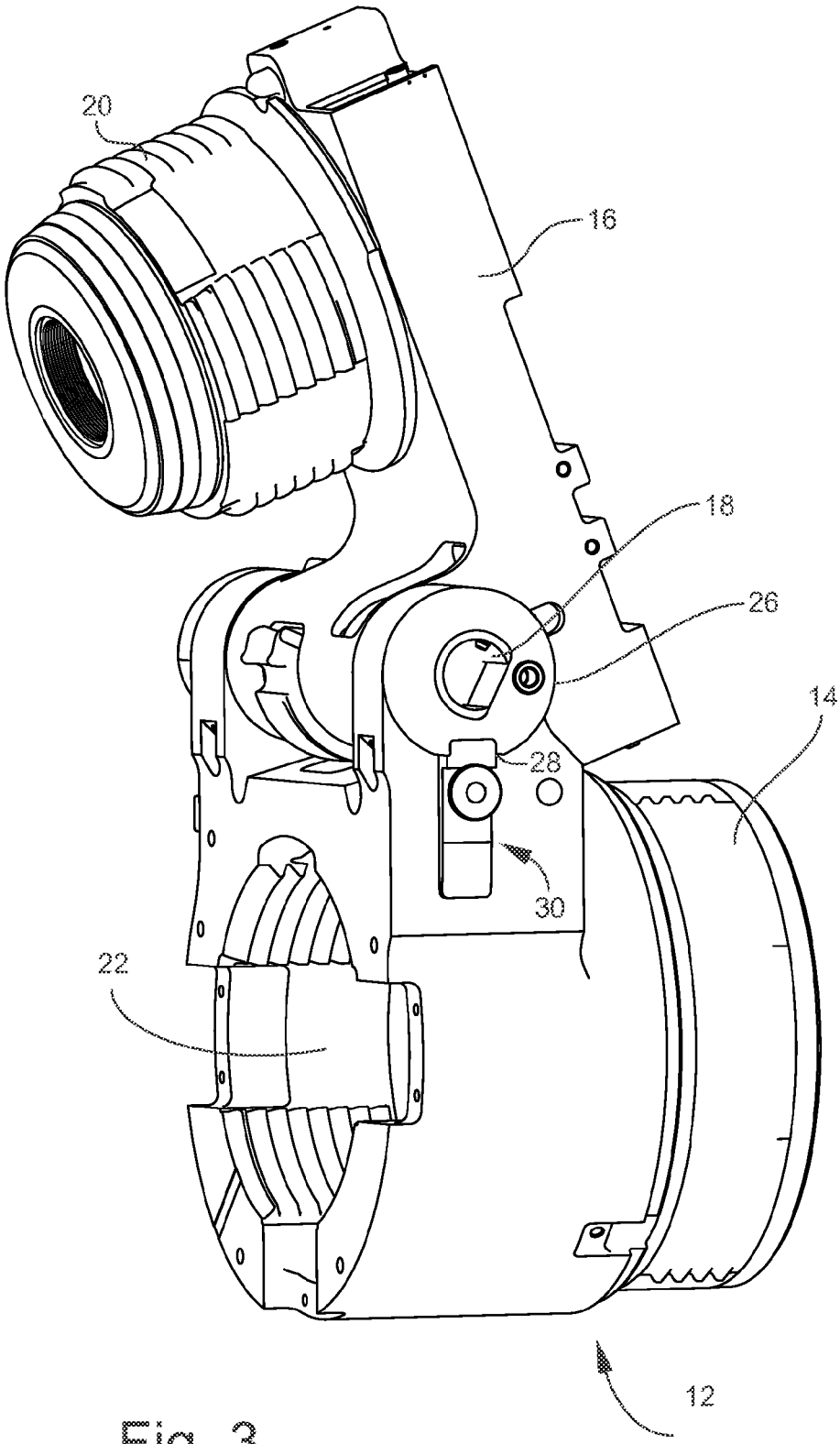
FIG. 3 is a perspective view of the breech assembly of FIG. 2 showing the breech block in a locked, open position.

FIG. 3 is a perspective view of breech assembly 12 showing breech block 20 in a locked, open position. In FIG. 3, lock 30 has been translated from its position in FIG. 2. In FIG. 3, lock 30 is disposed in notch 28 to thereby lock breech block 20 in the open position. Notch 28 may be formed at various locations on the periphery of crank end 26 to thereby lock breech block 20 in angular positions other than the position shown in FIG. 3.

Figure 4:
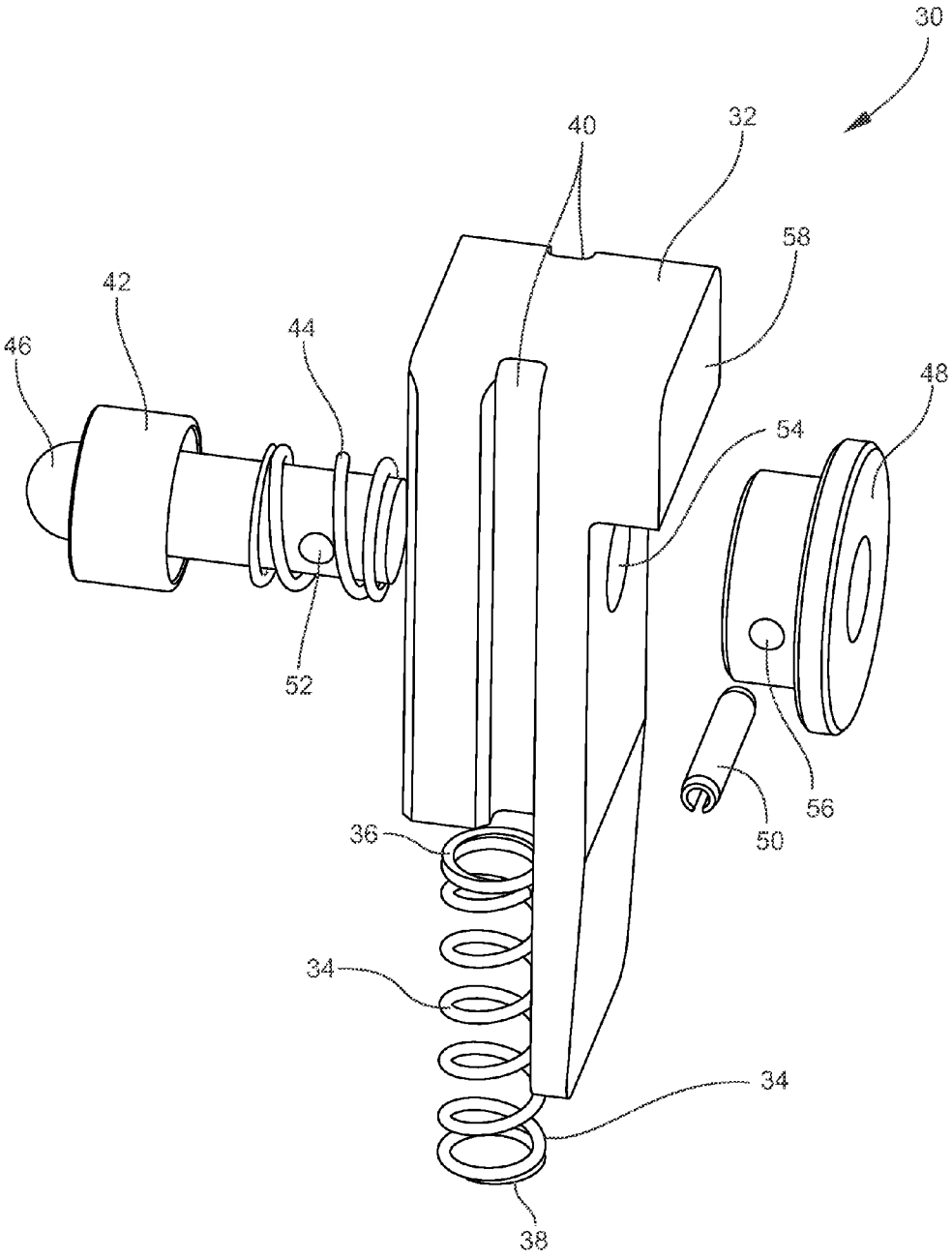
FIG. 4 is an exploded perspective view of one embodiment of a lock.

FIG. 4 is an exploded perspective view of one embodiment of lock 30. Lock 30 may include a slide body 32 and a spring 34 that biases slide body 32 towards crank end 26. Slide body 32 may be translatable in breech ring 14. An end 58 of slide body 32 may engage notch 28 to thereby lock breech block 20 in position. One end 36 of spring 34 may abut slide body 32 and another end 38 of spring 34 may abut breech ring 14. Slide body 32 may include grooves 40 formed therein for retaining slide body 32 in breech ring 14 and for guiding the translation of slide body 32 in breech ring 14.

Lock 30 may include a latching assembly for preventing slide body 32 from translating toward crank end 26. The latching assembly may also secure slide body 32 in a locked position (such as shown in FIG. 3, for example) wherein end 58 engages notch 28. The latching assembly (FIG. 4) may include a plunger 42 disposed in a bore 54 in slide body 32. A plunger spring 44 may bias plunger 42 toward breech ring 14. Plunger 42 may include a detent 46. Detent 46 may be removably disposed in detent holes (not shown) in breech ring 14. One detent hole may correspond to the position of lock 30 shown in FIG. 2 and one detent hole may correspond to the position of lock 30 shown in FIG. 3.

A plunger knob 48 may be fixed to plunger 42 using, for example, a split spring pin 50. Pin 50 may be inserted in knob opening 56 and plunger hole 52. Plunger knob 48 may be used to pull on plunger 42 and release detent 46 from a detent hole in breech ring 14. For example, before breech block 20 is removed from opening 22 in breech ring 14, one may pull on plunger knob 48 to remove detent 46 from its detent hole in breech ring 14. Spring 34 may then translate slide body 32 toward crank end 26. Breech block 20 may then be removed from opening 22 in breech ring 14 by rotating carrier 16, as seen in FIG. 2. As crank end 26 rotates, slide body 32 may bear against the perimeter of crank end 26 until end 58 of slide body 32 seats in notch 28 and locks carrier 16 and breech block 20 in position. Then, detent 46 may extend into a detent hole (not shown) formed in breech ring 14.

Figure 5:
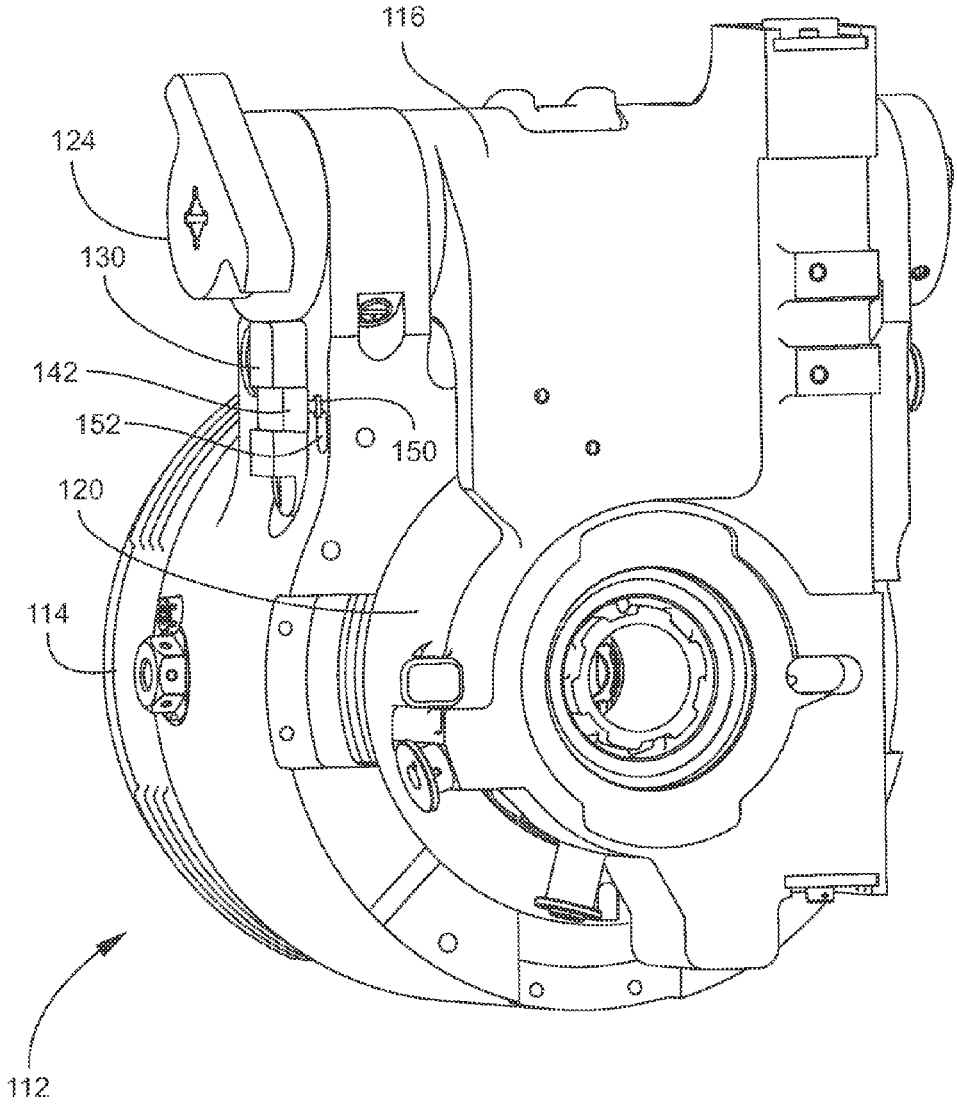
FIG. 5 is a perspective view of another embodiment of a breech assembly showing a breech block in a closed position and a pivoting latch disengaged from the breech ring.
Figure 6:
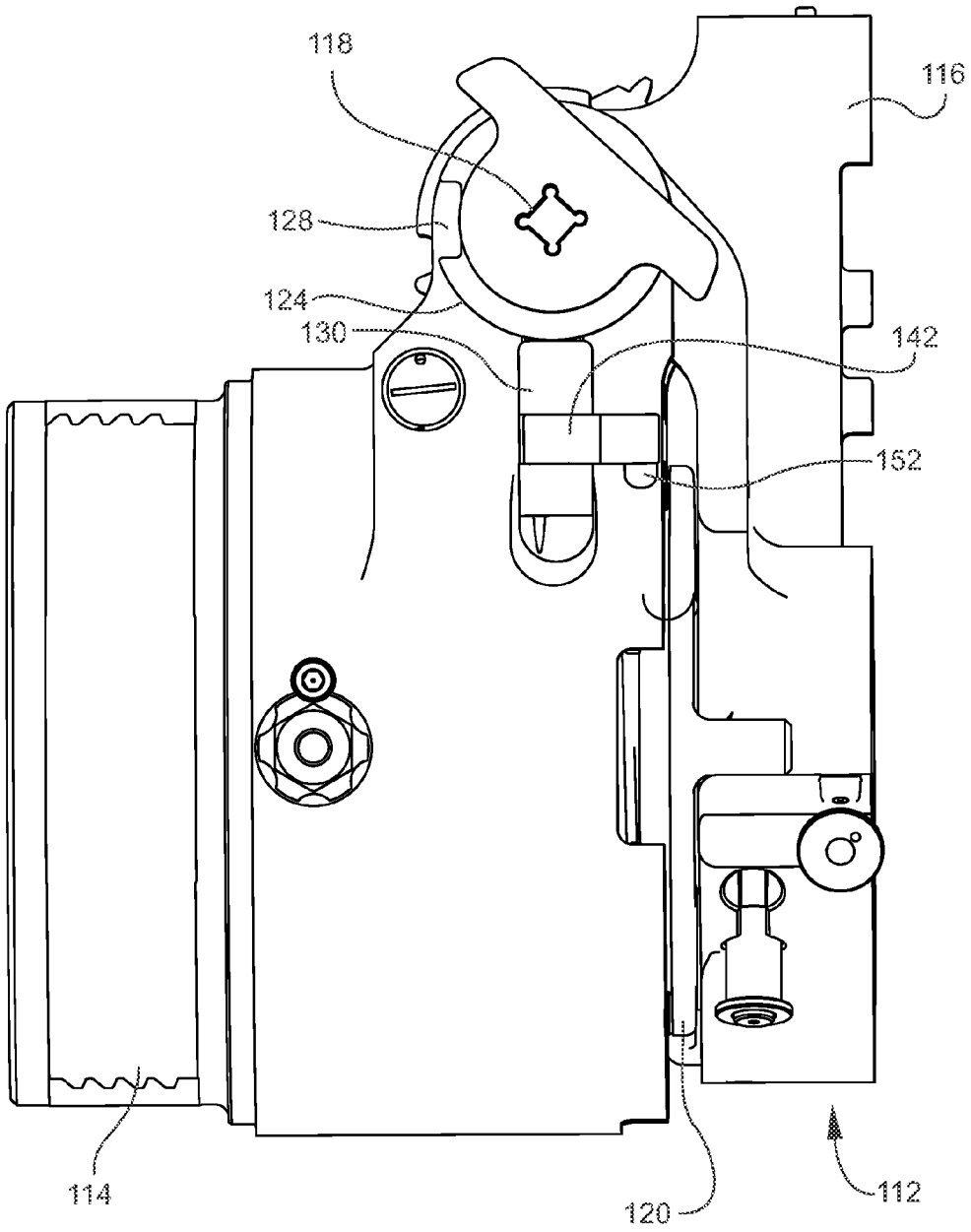
FIG. 6 is a side view of the breech assembly of FIG. 5 showing the breech block in the closed position and the pivoting latch engaged with the breech ring.

FIG. 5 is a perspective view of another embodiment of a breech assembly 112 showing a breech block 120 in a closed position and a pivoting latch 142 disengaged from a breech ring 114. FIG. 6 is a side view of breech assembly 112 showing breech block 120 in the closed position and pivoting latch 142 engaged with breech ring 114. A shaft 118 may be rotatably mounted to breech ring 114. A carrier 116 may be fixed to shaft 118. Breech block 120 may be fixed to carrier 116. Breech block 120 may be insertable into and out of an opening 122 (FIG. 7) in breech ring 114 by rotating shaft 118. In FIG. 5, breech block 120 is shown in a closed position with breech block 120 inserted in opening 122 in breech ring 114.

Figure 7:
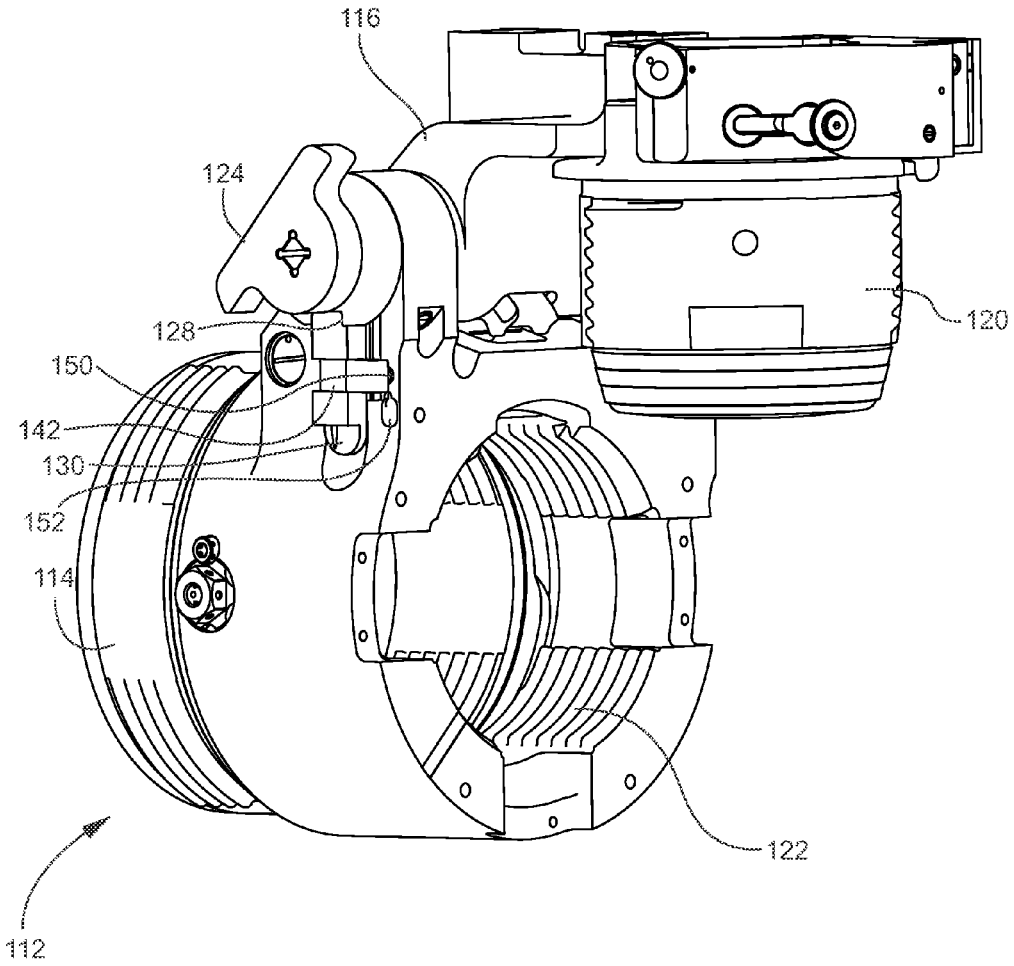
FIG. 7 is a side perspective view of the breech assembly of FIG. 5 showing the breech block in a locked, open position.
Figure 8:
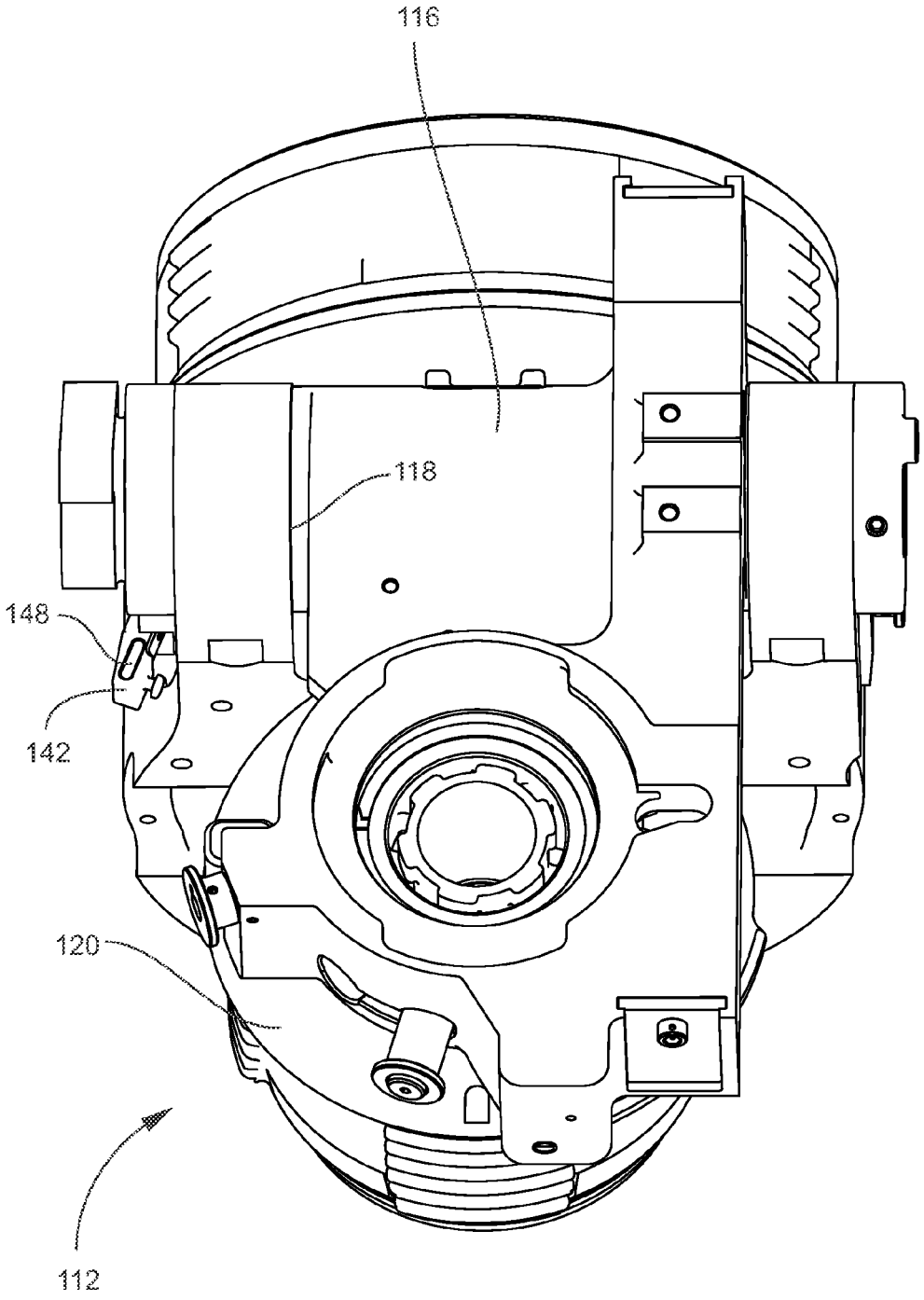
FIG. 8 is a top perspective view of the breech assembly of FIG. 5 showing the breech block in the locked, open position.

Shaft 118 may include a crank 124. Crank 124 may include a notch 128 (FIG. 6) formed in a periphery thereof. A lock 130 may be translatably disposed in breech ring 114. Lock 130 may be translatable into and out of notch 128 in crank 124. Notch 128 may be formed at various locations on the periphery of crank 124 to thereby lock breech block 120 in various angular positions. FIG. 7 is a side perspective view of breech assembly 112 showing breech block 120 in a locked, open position. FIG. 8 is a top perspective view of breech assembly 112 showing breech block 120 in the locked, open position.

Figure 9:
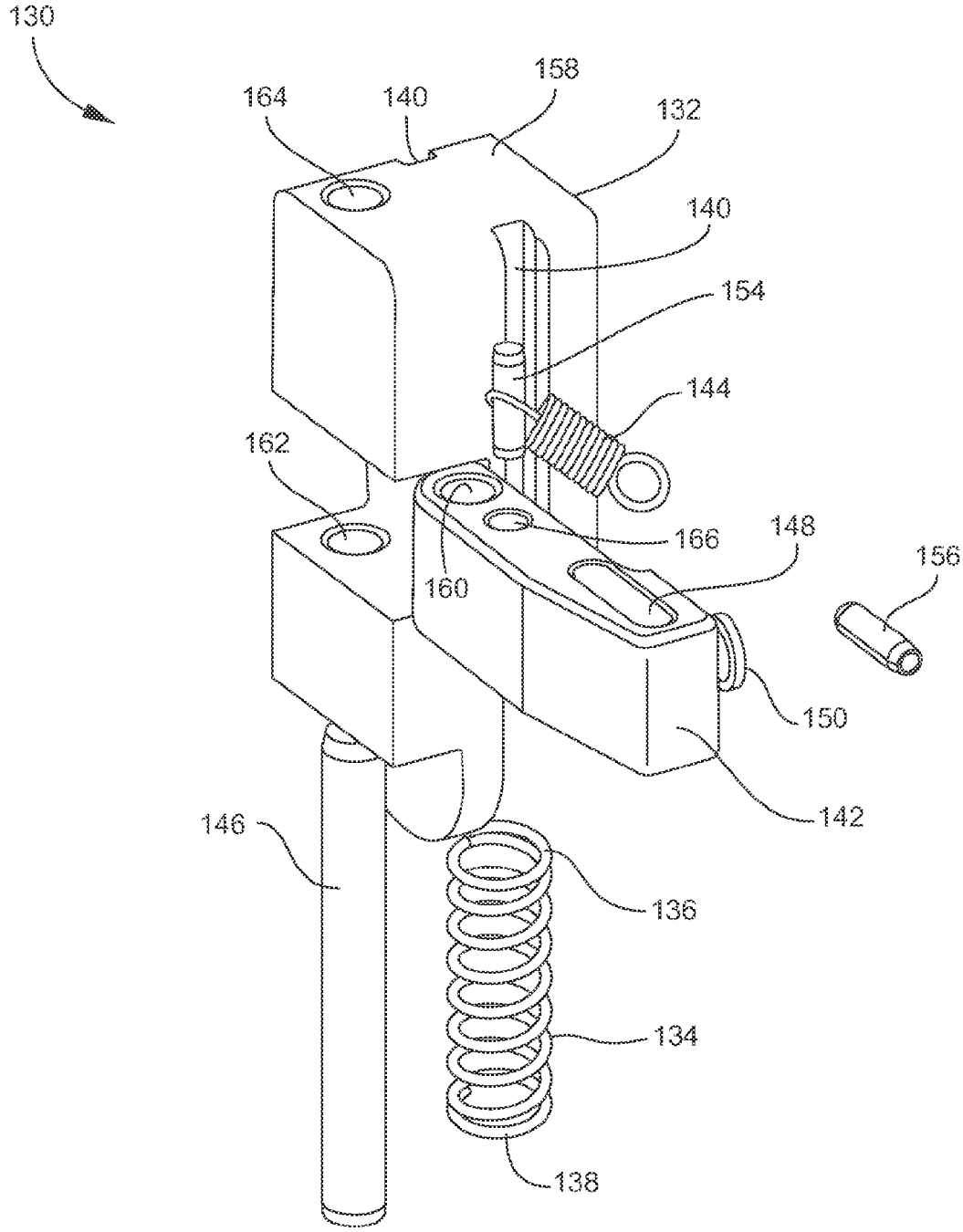
FIG. 9 is an exploded perspective view of another embodiment of a lock.

FIG. 9 is an exploded perspective view of lock 130. Lock 130 may include a slide body 132 and a spring 134 that biases slide body 132 towards crank 124. Slide body 132 may be translatable in breech ring 114. An end 158 of slide body 132 may engage notch 128 to thereby lock breech block 120 in position. One end 136 of spring 134 may abut slide body 132 and another end 138 of spring 134 may abut breech ring 114. Slide body 132 may include grooves 140 formed therein for retaining slide body 132 in breech ring 114 and for guiding the translation of slide body 132 in breech ring 114.

Lock 130 may include a latching assembly for preventing slide body 132 from translating toward crank 124. The latching assembly may include pivoting latch 142. Pivoting latch 142 may be rotatably fixed to slide body 132 and selectively engageable with breech ring 114. The latching assembly may include a latch spring 144 that biases pivoting latch 142 toward breech ring 114. Latch spring 144 may be disposed in an interior of slide body 132. Latch spring 144 may be connected at one end to a spring pin 154 disposed in an opening 166 in pivoting latch 142. Another end of latch spring 144 may be connected to a spring pin 156. Spring pin 156 may also be disposed in the interior of slide body 132.

Slide body 132 may include a hinge pin 146 on which pivoting latch 142 is rotatably mounted. Hinge pin 146 may be disposed in openings 162, 164 in slide body 132 and in opening 160 in pivoting latch 142. Pivoting latch 142 may include a slotted opening 148 at an end of latch 142 that is distal hinge pin 146. As seen in the top perspective view of FIG. 8, slotted opening 148 may be used to manipulate pivoting latch 142 from above using, for example, a flat screwdriver that may be inserted in slotted opening 148.

Pivoting latch 142 may include a button 150. Breech ring 114 may include a keyhole slot 152 (FIG. 7). Button 150 may be selectively engageable with keyhole slot 152. In FIG. 6, button 150 is engaged with an upper portion of keyhole slot 152. Movement of pivoting latch 142 downward (for example, using one's hand or using a tool in slotted opening 148) moves button 150 to the lower, larger portion of keyhole slot 152. Pivoting latch 142 may then be rotated outward, as shown in FIG. 5. Spring 134 (FIG. 9) may then bias slide body 132 against crank 124. As crank 124 rotates, spring 134 may bias end 158 of slide body 132 into notch 128 in crank 124, thereby securing breech block 120 in an open position (FIG. 7).

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A breech assembly for a weapon, comprising:

a breech ring;

a carrier fixed to a shaft, the shaft being rotatably mounted to the breech ring;

a breech block fixed to the carrier and insertable into and out of an opening in the breech ring by rotating the shaft;

a notch formed in an end of the shaft; and a bar translatably disposed in the breech ring and translatable into and out of the notch in the end of the shaft; wherein translation of the bar into the notch rotatably locks the shaft with respect to the breech ring, and wherein the bar includes a slide body and a spring that biases the slide body towards the shaft, and wherein the slide body includes grooves formed therein for retaining the slide body in the breech ring, and wherein the bar further includes a latching assembly for securing the bar out of engagement with the notch, and wherein the latching assembly includes a pivoting latch that is rotatably fixed to the slide body and selectively engageable with the breech ring, and wherein the latching assembly includes a latch spring that biases the pivoting latch toward the breech ring, and wherein the slide body includes a hinge pin on which the pivoting latch is rotatably mounted, and wherein the pivoting latch includes a slotted opening at an end distal the hinge pin, and wherein the pivoting latch includes a button and the breech ring includes a keyhole slot and further wherein the button is selectively engageable with the keyhole slot.

2. A breech assembly for a weapon, comprising:

a breech ring;

a carrier fixed to a shaft, the shaft being rotatably mounted to the breech ring;

a breech block fixed to the carrier and insertable into and out of an opening in the breech ring by rotating the shaft;

a notch formed in an end of the shaft; and a bar translatably disposed in the breech ring and translatable into and out of the notch in the end of the shaft; wherein translation of the bar into the notch rotatably locks the shaft with respect to the breech ring, and wherein the bar includes a slide body and a spring that biases the slide body towards the shaft, and wherein the slide body includes grooves formed therein for retaining the slide body in the breech ring, and wherein the bar further includes a latching assembly for securing the bar out of engagement with the notch, and wherein the latching assembly includes a plunger disposed in a bore in the slide body and a plunger spring that biases the plunger toward the breech ring, and wherein the plunger includes a detent on an end thereof, and wherein another end of the plunger includes a knob for pulling the plunger.

* * * * *